US005360216A

United States Patent [19]

Counterman

[11] Patent Number: 5,360,216

[45] Date of Patent: Nov. 1, 1994

[54] TIME BOARD GAME

[76] Inventor: Christopher S. Counterman, R.R. #1, Box 441, Scotrun, Pa. 18355

[21] Appl. No.: 222,901

[22] Filed: Apr. 5, 1994

[51] Int. Cl.[5] ..... A63F 3/00

[52] U.S. Cl. ..... 273/243

[58] Field of Search ..... 273/242, 243, 248, 249, 273/251-254, 148 R; 434/304

[56] References Cited

U.S. PATENT DOCUMENTS

| | | | |
|---|---|---|---|
| D. 172,317 | 5/1954 | Shellman . | |
| 848,839 | 4/1907 | Monroe . | |
| 2,647,330 | 1/1950 | Ford . | |
| 3,022,582 | 2/1962 | Pitt . | |
| 4,126,851 | 11/1978 | Okor | 273/DIG. 28 |
| 4,545,768 | 10/1985 | Hinnen . | |
| 4,572,513 | 2/1986 | Evans | 273/242 |
| 4,662,635 | 5/1987 | Enokian | 273/DIG. 28 |
| 4,799,890 | 1/1989 | Thompson et al. . | |
| 4,817,959 | 4/1989 | Tinsley . | |
| 5,098,101 | 3/1992 | Jones | 273/148 R |

FOREIGN PATENT DOCUMENTS

| | | | |
|---|---|---|---|
| 2631245 | 11/1989 | France | 273/260 |

*Primary Examiner*—William E. Stoll

*Attorney, Agent, or Firm*—Kenneth P. Glynn

[57] ABSTRACT

The present invention is an educational time board game. It includes a game board, a space track, at least one START space and one FINISH space on the board physically associated with the space track, a clock which has a normal clock face thereon and includes a mechanism for moving at least five times faster than a normal clock, a stop button connected to the clock, a first plurality of cards, being time cards having preselected various times stated thereon, a second plurality of cards, such cards indicating various predetermined penalties thereon, a third plurality of cards, such cards indicating various rewards thereon, chance device for determining a movement along the space track, and, a plurality of pieces for movement along the space track. The space track on the game board runs continuously around the game board and is divided into a predetermined number of sequential spaces. The game board and space track are preferably rectangular, e.g. square, having four inner corners and further including four diagonal track extensions connected thereto with four separate START and FINISH spaces to accommodate up to four players.

20 Claims, 2 Drawing Sheets

TIME BOARD GAME

BACKGROUND OF THE INVENTION

1. Field of the Invention

The present invention involves a board game, and, more particularly one-which is for competition among two or more players. The game utilizes an accelerated clock and winning requires speed, skill and luck.

2. Information Disclosure Statement

Interactive clocks and games used to assist in teaching or gaining experience in telling time are known. The following patents are examples:

U.S. Pat. No. 172,317 to Norman C. Shellman involves an ornamental design for an educational dial for a clock.

U.S. Pat. No. 848,839 to Dan C. Monroe describes a game which includes a game board containing the representation of a clock-face, embodying Roman numerals for the hours and a circular series of Arabic numerals designating the minutes, the two sets of numerals being of contrasting colors and freely-pivoted dummy hands mounted within the clock-face, the hands being of contrasting colors corresponding to the colors of the two sets of numerals.

U.S. Pat. No. 2,647,330 to Silas M. Ford describes a puzzle game including a game piece having a generally circular aperture therein, a removable irregularly shaped center piece located in the center of the aperture, a pair of hands pivotally connected to the center piece, a series of twelve puzzle pieces encircling the center piece and interfitting therewith along an irregular line, a numeral on each of the twelve puzzle pieces, these numerals corresponding in value and location to the numerals of a clock dial, each of the puzzle pieces having a generally curved outer and similar radially extending sides, and interfitting means between one of the twelve game pieces and the periphery of the aperture to definitely locate one game piece relative to the aperture.

U.S. Pat. No. 3,022,582 to Catherine J. Pitt relates to a time teaching educational device for teaching pupils how to tell time, being simple in construction, and including a clock-face, multi-colored pegs and a pair of groups of time indicating cards, one for hours and one for minutes. The pegs are used by the students to indicate and learn minutes intervals.

U.S. Pat. No. 4,545,768 to John Hinnen describes an activity center which includes a plurality of polygonal frames pivotally connected together. Each frame includes an open area accessible from each side thereof and an activity device mounted therein whereby each device is accessible from either side of its respective frame. Included is a clock with movable hands for learning to tell time.

U.S. Pat. No. 4,799,890 to Barbara J. Thompson et al. involves an electronic learning device for teaching students how to tell time including a plurality of keys, video and/or audio means and a plurality of operational modes.

U.S. Pat. No. 4,817,959 to Judy O. Tinsley describes an educational game for teaching children to tell time which involves a playing board with a racetrack printed thereon. Players take turns moving their markers around the racetrack in accordance with their ability to correctly set the hands of a clock provided on the board to match various times printed on cards drawn from a deck.

U.S. Pat. No. 5,098,101 to Benjamin B. Jones describes a time recorder of multiple events and durations of time, using one or more rotatably mounted dials graduated in a clockwise direction, with a means for displaying temporary memoranda which describe events associated with the graduations, and used for directly recording and reading the actual or simulated times of one or more events either in absolute time or relative to the current time.

Notwithstanding the substantial prior art available, there is no teaching or suggestion which would render obvious the present invention time board game.

SUMMARY OF THE INVENTION

The present invention is an educational time board game. It includes a game board, a space track, at least one "START" space and one "FINISH" space on the board physically associated with the space track, a clock which has a normal clock face thereon and includes a mechanism for moving at least five times faster than a normal clock, a stop button connected to the clock, a first plurality of cards, being time cards having pre-selected various times stated thereon, a second plurality of cards, such cards indicating various predetermined penalties thereon, a third plurality of cards, such cards indicating various rewards thereon, chance device for determining a movement along the space track, and, a plurality of pieces for movement along the space track. The space track on the game board runs continuously around the game board and is divided into a predetermined number of sequential spaces. The game board and space track are preferably rectangular, e.g. square, having four inner corners and further including four diagonal track extensions connected thereto with four separate "START" and "FINISH" spaces to accommodate up to four players.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

The present invention involves an educational game which utilizes an accelerated clock along with movement pieces, a game board, reward and penalty cards and TIME cards. Winning the present invention game requires a combination of speed, skill and luck. The game can be played by two, three or four players or could even be modified for more players and can be played with a slower clock or a faster clock, depending upon the age and skill of the players. The present invention game can be used both for telling time and for speeding up the time telling learning time due to the frequent number of different times that will be identified by the players in the course of a normal game.

Figure 1:
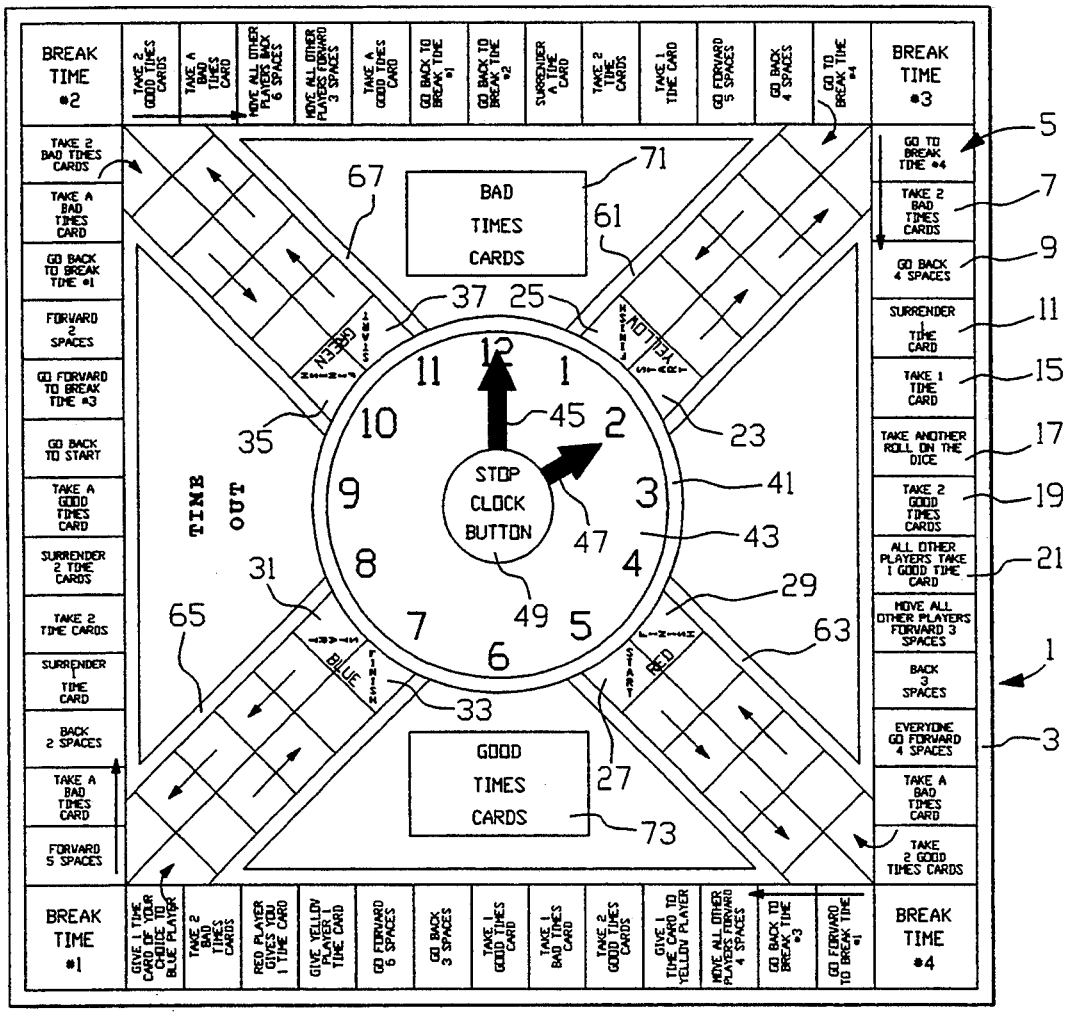
FIG. 1 is a top view of a preferred embodiment of a present invention game board with cards and a clock; and, FIG. 2 shows a component frame and the various components of a present invention game contained therein.

Referring to FIG. 1, there is shown a present invention educational time board game 1, which includes board 3 and clock 41. Game board 1 includes a space track 3, in this case, a track which runs along the full length of the perifery of rectangular board 3 and further includes four diagonal track extensions 61, 63, 65 and 67. (By "rectangular" as used herein, is meant four sided shapes which includes squares and oblong rectangles. However, the gameboard could be circular, pentagonal or otherwise shaped, as may be desired. ) There are a pre-determined number of sequential spaces such as spaces 5, 7, 9, 11, 15, 17, 19 and 21. Additionally, there are "START" spaces 23, 27, 31 and 37 and "FINISH" spaces 25, 29, 33 and 35. Clock 41 has a normal face 43 with hands 45 and 47 but has a mechanism on its underside (not shown) for setting the speed thereof within a pre-determined range. For example, the clock may operate at 5 to 20 times the speed of the normal clock. Also, there is a stop clock button 49 which the players must depress to stop the clock at times set on their own individual "TIME" cards, which is more fully discussed in conjunction with the instructions below. Additionally, a stack of "BAD TIMES" cards 71 and a stack of "GOOD TIMES" cards 73 are also included. These are basically penalty cards and reward cards.

Figure 2:
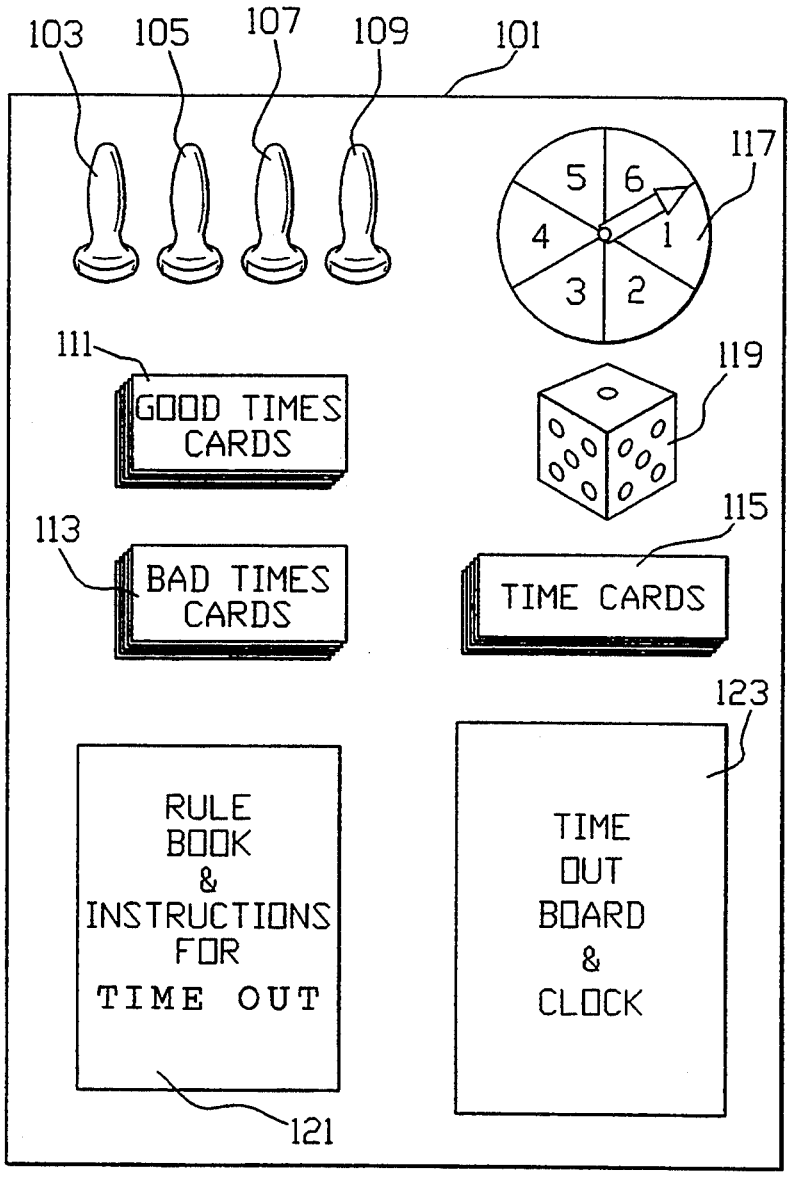

Referring now to FIG. 2, there is shown a component frame 101 which includes pieces 103, 105, 107 and 109 for movement along game board 3. There is a stack of "GOOD TIMES" cards and a stack of "BAD TIMES" cards 113. There is a rule book and instructions 121, the board and clock 123, TIME cards 115 which are dealt to the players, and chance means such as spinner 117 or dice such as die 119.

In one preferred embodiment, the rules of the game are as follows:

1.) Each player is dealt time cards, e.g. 5 cards each (displayed or numbered time);

2.) The clock is set; the pieces are placed on their respective "START" spaces;

3.) The player must stop the clock at a time on his or her cards. (One limit on time range may be plus or minus 3 minutes for children or plus or minus 1 minute for adults.);

4a.) If successful in stopping clock, the player. gets to roll the die or spin the spinner and move its pieces;

4b.) If not successful in stopping clock, the player goes back to his/her last position, loses a turn, or takes a "BAD TIMES" card;

5.) On whatever space a player lands he/she must do what the space says, e.g. take a card etc.;

6.) When a player is finished with turn, the used TIME card is placed on the bottom of the deck and a new card is drawn for that player's hand.

7.) The clock is started;

8.) Repeat above rules until someone gets to FINISH.

GOOD TIME cards may have rewards, such as,

Advance cards
Save a lost turn
Get out of breaktime free
Pick extra time card

BAD TIME cards may have penalties, such as,

Go back to breaktime
Give up a time card
Go back to x space
Move clock forward 3 hours and restart
Move clock backwards 6 hours and restart

ETC...

The above rules are exemplary and could be modified to achieve the results of a fun time while helping players to learn better how to tell time.

Obviously, numerous modifications and variations of the present invention are possible in light of the above teachings. It is therefore understood that within the scope of the appended claims, the invention may be practiced otherwise than as specifically described herein.

What is claimed is:

1. An educational time board game, which comprises:

a) a game board;

b) a space track on said game board which runs continuously around said game board and is divided into a predetermined number of sequential spaces;

c) at least one START space and one FINISH space on said board physically associated with said space track on said board;

d) a clock which has a normal clock face thereon and includes mechanical setting means for automatically moving the clock least five times faster than a normal clock;

e) stop means connected to said clock;

f) a first plurality of cards, being time cards having pre-selected various times stated thereon;

g) a second plurality of cards, such cards indicating various predetermined penalties thereon;

h) a third plurality of cards, such cards indicating various rewards thereon;

i) chance means for determining a movement along said space track; and, j) a plurality of pieces for movement along said space track.

2. The educational time board game of claim 1 wherein said clock includes means for controlling the speed of the clock.

3. The educational time board game of claim 1 wherein said second plurality of cards are BAD TIMES cards.

4. The educational time board game of claim 3 wherein said BAD TIMES cards include penalties from the group consisting of having a player move backward, having other players move forward, sacrificing at least one card from said first plurality of cards and sitting out one turn of stopping said clock.

5. The educational time board game of claim 1 wherein said third plurality of cards are GOOD TIMES cards.

6. The educational time board game of claim 5 wherein said GOOD TIMES cards included rewards from the group consisting of having a player move forward, having other players move backward, obtaining at least one additional card from said first plurality of cards and having other players sit out one turn of stopping said clock.

7. The educational time board game of claim 1 wherein said game board is rectangular.

8. The educational time board game of claim 7 wherein said space track is rectangular.

9. The educational time board game of claim 8 wherein said rectangular space track has four inner corners and further includes four diagonal track extensions connected thereto with four separate START and FINISH spaces to accommodate up to four players.

10. The educational time board game of claim 9 wherein said clock includes means for controlling the speed of the clock.

11. The educational time board game of claim 9 wherein said second plurality of cards are BAD TIMES cards.

12. The educational time board game of claim 11 wherein said BAD TIMES cards include penalties from the group consisting of having a player move backward, having other players move forward, sacrificing at least one card from said first plurality of cards and sitting out one turn of stopping said clock.

13. The educational time board game of claim 9 wherein said third plurality of cards are GOOD TIMES cards.

14. The educational time board game of claim 13 wherein said GOOD TIMES cards included rewards from the group consisting of having a player move forward, having other players move backward, obtaining at least one additional card from said first plurality of cards and having other players sit out one turn of stopping said clock.

15. The educational time board game of claim 9 wherein said game board is rectangular.

16. The educational time board game of claim 15 wherein said space track is rectangular.

17. The educational time board game of claim 1 wherein said clock is a battery operated, 12-hour clock.

18. The educational time board game of claim 1 wherein said clock runs at least 5 times faster than a normal clock.

19. The educational time board game of claim 1 wherein said chance means is a spinner.

20. The educational time board game of claim 1 wherein said chance means is at least one die.

* * * * *